US005305062A

United States Patent [19]

Sato et al.

[11] Patent Number: 5,305,062

[45] Date of Patent: Apr. 19, 1994

[54] CONDUCTIVE STRUCTURE FOR ELECTROPHOTOGRAPHIC IMAGING DEVICE

[75] Inventors: Tsutomu Sato, Tokyo; Satoru Morisawa, Kita, both of Japan

[73] Assignee: Asahi Kogaku Kogyo Kabushiki Kaisha, Tokyo, Japan

[21] Appl. No.: 775,892

[22] Filed: Oct. 15, 1991

[30] Foreign Application Priority Data

Oct. 15, 1990 [JP] Japan ..... 2-107807[U]

[51] Int. Cl.[5] ..... G03G 15/00

[52] U.S. Cl. ..... 355/245; 355/200; 439/17

[58] Field of Search ..... 355/200, 245, 246, 259; 118/653; 439/17, 11, 13

[56] References Cited

U.S. PATENT DOCUMENTS 3,581,267 5/1971 Schreffler ..... 439/17 X
4,714,819 12/1987 Yamashita ..... 219/471 X
4,951,599 8/1990 Damji ..... 355/200
4,967,691 11/1990 Chikama et al. ..... 118/656

FOREIGN PATENT DOCUMENTS 2-29677 1/1990 Japan ..... 355/274
2-251870 10/1990 Japan ..... 355/245

*Primary Examiner*—Joan H. Pendegrass
*Attorney, Agent, or Firm*—Sandler Greenblum & Bernstein

[57] ABSTRACT

A structure is provided capable of electrically connecting a terminal member to a rotatable member, which is rotatably supported by a fixed member in an electrophotographic imaging device. In the structure, a first member secured to the rotatable member and rotated therewith and a second member secured to the fixed member are provided. The first and second members are conductive and electrically connected with each other. Further, the terminal member is engaged with the second member so that the terminal member is electrically connected to the rotatable member via the first and second members.

14 Claims, 2 Drawing Sheets

CONDUCTIVE STRUCTURE FOR ELECTROPHOTOGRAPHIC IMAGING DEVICE

BACKGROUND OF THE INVENTION

The present invention relates to a conductive structure which enables a rotatable roller member to be conducted in the developing unit of an image formation apparatus making use of electrophotography.

Conventionally, an imaging forming apparatus is know, such as a copy machine, a laser beam printer and the like, making use of a so-called electrophotographic image forming method wherein the uniformly charged surface of a photoconductive drum is exposed to light to form a latent image, then charged toner is adhered to the latent image by a developing device to form a toner image, and the toner image is transferred onto a recording sheet and fixed thereon.

In an electrophotographic image forming apparatus as described above, for example, toner accommodated in a developing device is adhered to the photoconductive drum by means of a developing roller. The developing roller, for example, is constructed as follows. A magnet roller having magnetic poles disposed on the outer circumference thereof is rotatably fitted in a cylindrical sleeve composed of a conductive member. The toner is held on the sleeve by the magnetic force of the magnet roller, and a bias voltage. The bias voltage is lower than the voltage of the uniformly charged surface of the photoconductive drum, and higher than that of a latent image formed on the surface of the photoconductive drum by being exposed to light. Thus the toner is charged on the sleeve and transferred onto latent image on the surface of the photoconductive drum.

In the developing device as described above, a structure for applying voltage to the rotating sleeve is constructed such that a contact member having elasticity is urgingly pressed and abutted against the rotary shaft of the sleeve in the radial direction thereof.

With the above arrangement, however, contact failure may occur due to fatigue or deformation of the contact member, or adhered dust and the like, which affects the developing operation, and may result in a poor image formation.

Note that when an abutting force of the contact member is increased to improve the conductivity thereof, a rotating resistance between the contact member and the shaft of the sleeve is increased, which requires an increased rotating drive force, thereby increasing manufacturing cost.

SUMMARY OF THE INVENTION

It is therefore an object of the present invention to provide a structure capable on stably applying voltage to a rotating sleeve without increasing the load of the rotary shaft of the sleeve.

For the above object, according to the present invention, there is provided a structure for electrically connecting a rotatable member with a terminal member, wherein the rotatable member is rotatably supported by a fixed member. The structure includes a first member secured to the rotatable member, to be rotated therewith and a second member secured to the fixed member. The first and second members are conductive and electrically connected with each other. Thus, the terminal member is engaged with the second member so that the terminal member is electrically connected to the rotatable member via the first and second members.

Optionally, the first and second members may comprise inner and outer ring members of a ball bearing unit, respectively, wherein the ball bearing unit is provided with a plurality of balls made of conductive material between the inner and outer ring members.

Further, grease that is provided between the inner and the outer members may be made of a conductive material so as to increase the conductivity between the first and second members.

Further optionally, the ball bearing unit is fitted in an opening formed on the fixed member and the terminal member may comprise a substantially C-shaped contact plate member. The outer ring member is formed with a groove along the circumferential surface thereof so that the C-shaped contact plate member can be fitted in the groove. Thus, the ball bearing unit is prevented form coming out of the opening in which the bearing fitted.

According to another aspect of the invention, there is provided a developing device employed in an electrophotographic imaging device for developing a latent image formed on a charged photoconductive member into a toner image. The developing device comprises a chamber for accommodating toner, a developing roller for charging toner and adhering the charged toner to the latent image formed on the charged photoconductive member, a terminal member for supplying voltage to the developing roller, and a bearing mechanism for rotatably supporting the developing roller. The first part of the bearing mechanism contacts the developing roller while the second part is secured to the imaging device. The first and second parts are being electrically connected, and the terminal member contacts the second part to the bearing mechanism so that the terminal member is electrically connected to the developing roller.

DESCRIPTION OF THE ACCOMPANYING DRAWINGS

FIG. 1 is a cross sectional view of the end portion of the developing roller of a developing device to which a contact structure embodying the present invention is applied; and FIG. 2 is a cross sectional view taken along the line II—II of FIG. 1.

DESCRIPTION OF THE EMBODIMENT

Figure 1:
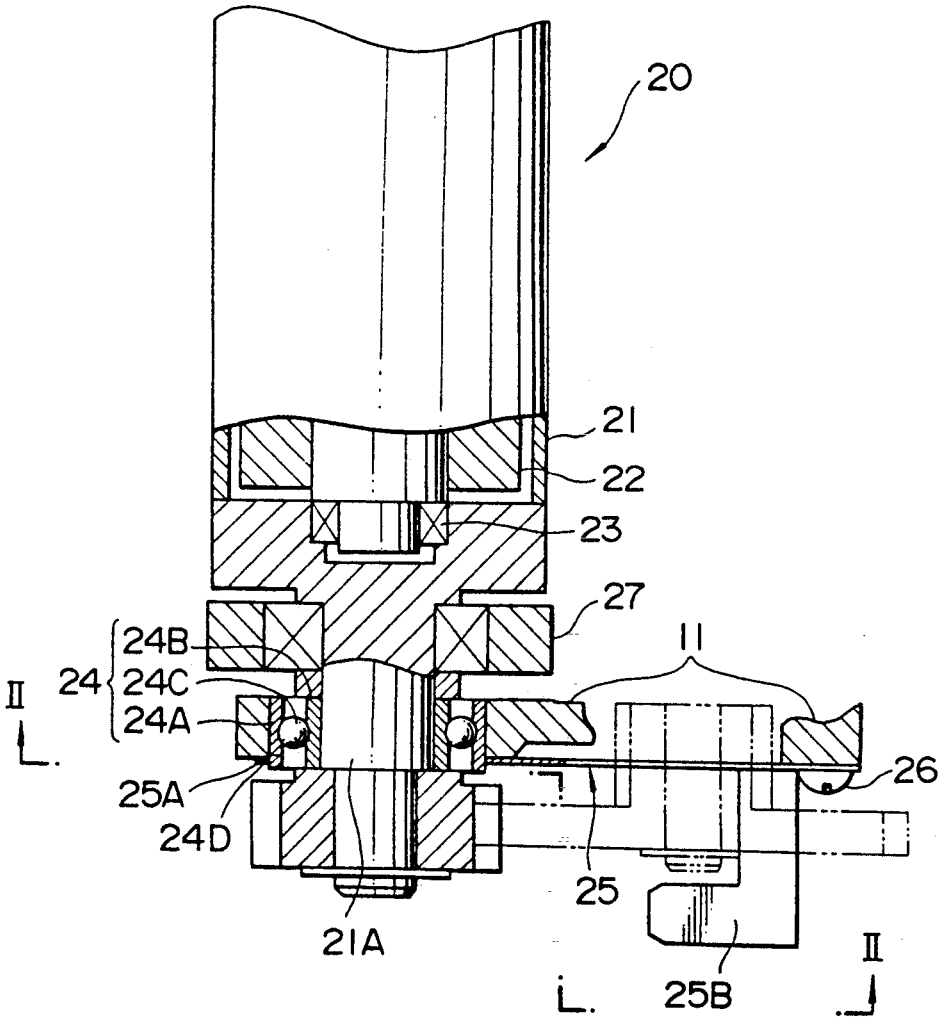
Figure 2:
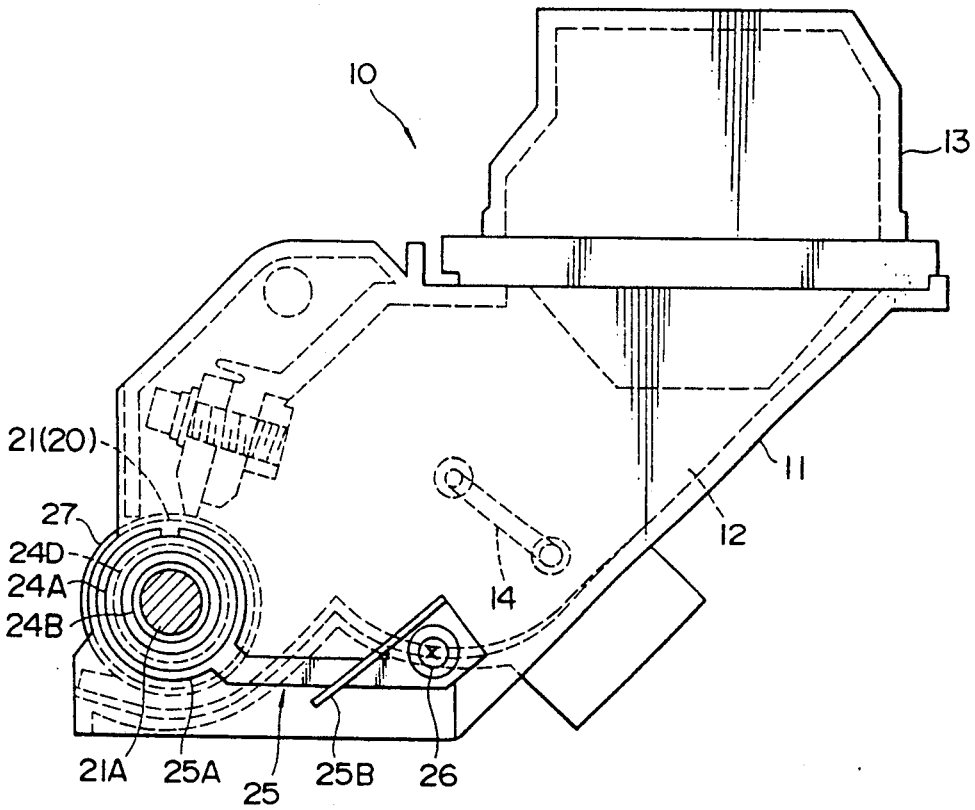

FIG. 1 is a cross sectional view of the end portion of the developing roller of a developing device to which a contact structure embodying the present invention is applied, and FIG. 2 is a cross sectional view taken along the line II—II of FIG. 1.

The developing unit 10 shown in FIG. 2 is arranged such that a case 11 forms a substantially cylindrical toner accommodating portion 12. A developing roller 20 is disposed at an obliquely downward position of the toner accommodating portion 12. An opening is defined at a portion opposite to the developing roller 20 with respect to the toner accommodating portion 12 (i.e., an obliquely upper portion of the toner accommodating portion 12), and a toner cartridge 13 is coupled to the case 11 at the opening to supply toner.

A scraper 14 is disposed at the center of the toner accommodating portion 12 for rotating and supplying the toner to the developing roller 20 as well as for stirring the toner.

The developing roller 20 is arranged such that a magnet roller 22 is rotatably fitted in a cylindrical sleeve 21, with the magnet roller 22 being supported by a ball bearings 23. A shaft portion 21A is formed at each end side of the sleeve 21, and the shaft portion 21A is supported by the case 11 via ball bearings 24 as a bearing member. A gear 28 is fixedly provided on one of the shaft portions 21A protruding from the supporting portion as shown in FIG. 1, and thus the sleeve 21 is driven to rotate through the gear 25.

More specifically, the outer ring 24A of the ball bearing 24 rotatably supporting the developing roller 20 is fixedly fitted in the case 11, and the inner ring 24B of the ball bearing 24 is fixedly engaged with the shaft portion 21A, thus the outer ring 24A and the inner ring 24B can be relatively rotated with a low friction as steel balls 24C are interposed between the outer ring 24A and inner ring 24B.

Note that the other end of the magnet roller 22, which is not shown in FIG. 1, protrudes from the sleeve 21 to the outside and can be driven to rotate independently of the sleeve 21. Further, designated by numeral 27 in the figures is a developing gap roller having a radius larger than that of the outer circumference of the developing roller 20 by a gap between the circumferential surface of the developing roller 20 and the outer circumference of a photoconductive drum. The developing gap roller 27 is abutted against the photoconductive drum at the end portion thereof which does not contribute to the image formation to keep a predetermined developing gap.

A receiving groove 24D is defined along the outer circumference of the outer ring 24A of the ball bearing 24 provided at the both ends of the developing roller 20. By engaging a stop ring with the receiving groove 24D, the sleeve 21 is rotatably supported by the case 11 of the developing unit 10.

In the embodiment according to the present invention, a snap terminal 25 serving as a contact is engaged with the groove 24D of one of the ball bearings 24 which is shown in FIG. 1.

The snap terminal 25 is formed such that a terminal portion 25B extends from the snap portion 25A which is engaged with the groove 24D. The terminal portion 25B is fixed to the side of the case 11 by a screw 26. It should be noted that in the present embodiments, the outer ring 24A of the ball bearing 24, the inner ring 24B of the ball bearing, the steel balls 24C, and the shaft portion 21C are all conductive.

According to the above construction, the terminal portion 25B and the sleeve 21 are electrically connected so that voltage can be applied to the sleeve 21 from the terminal portion 25B.

Note that a better conductivity can be obtained by using a conductive grease as the grease to be filled to lubricate the steel balls 24C between the inner ring 24B and outer ring 24A of the ball bearing 24, and injecting a conductive grease between the inner ring 24B and the shaft portion 21A of the sleeve 21 as necessary.

Although in the above described embodiment, the snap terminal 25 is engaged with the groove 24D defined on circumferential surface of the outer ring 24A to electrically connect the sleeve 21 with the terminal 25, the present invention is not limited to the arrangement. A similar effect can be obtained by simply abutting a contact member against the outer ring 24A of the ball bearing. Further, the bearing member is not limited to the ball bearing but a rolling bearing such as a roller bearing or a sliding bearing may also be used.

As discussed above, according to the present invention, the contact member can be electrically connected to the rotating sleeve by making the contact member contact the portion of the bearing member which does not rotate. Therefore, the lost of spring force and deformation can be avoided, and dust and the like are prevented from sticking to the contact member, thereby a sufficient conductivity can be obtained. Further, the contact does not act as a rotating resistance to the sleeve.

The present disclosure relates to subject matter contained in Japanese Utility Model Application No.HEI 2-107807 (filed on Oct. 15, 1990) which is expressly incorporated herein by reference in its entirety.

What is claimed is:

1. A structure for electrically connecting a rotatable member with a terminal member, said rotatable member being rotatably supported by a fixed member, said structure comprising:

a first member secured to said rotatable member, to be rotated with said rotatable member;

a second member secured to said fixed member;

said first and second members being conductive and being electrically connected with each other;

wherein said terminal member is engaged with said second member so that said terminal member is electrically connected to said rotatable member via said first and second members, said terminal member being disengagable from said second member independently of said second member;

said first and second members comprising inner and outer ring members of a ball bearing unit, respectively, wherein said ball bearing unit is provided with a plurality of balls made of conductive material disposed between said inner and outer ring members, and said terminal member comprising a substantially C-shaped contact plate member and said outer ring member is formed with a groove along the circumferential surface thereof so that said C-shaped contact plate member can be fitted in said groove.

2. The structure according to claim 1, wherein a conductive grease is filled between said inner and outer ring members for lubricating said ball bearing unit.

3. The structure for electrically connecting a rotatable member with a terminal member according to claim 1, said contact plate member comprising a substantially planar member.

4. The structure for electrically connecting a rotatable member with a terminal member according to claim 1, said groove and said plate member comprising means for fixedly coupling said terminal member to said second member.

5. The structure for electrically connecting a rotatable member with a terminal member according to claim 1, said groove comprising a substantially annular groove.

6. A developing device employed in an electrophotographic imaging device for developing a latent image formed on a charged photoconductive member to a toner image, said developing device comprising:

a chamber for accommodating toner;

a developing roller for charging toner and adhering the charged toner to said latent image formed on the charged photoconductive member;

a terminal member for supplying voltage to said developing roller; and bearing means for rotatably supporting said developing roller, a first part of said bearing means contacting said developing roller while a second part of said bearing means is secured to said imaging device, said first and second parts being electrically connected, wherein said terminal member contacts said second part of said bearing means so that said terminal member is electrically connected to said developing roller, said terminal member being disengageable from said second part of said bearing member independently of said second part of said bearing means;

said bearing means comprising a ball bearing unit, said first and second parts of said bearing means comprising inner and outer ring members of said ball bearing unit, respectively, and said ball bearing unit comprises a plurality of balls made of conductive material disposed between said inner and outer ring members, said terminal member comprises a substantially C-shaped contact plate member, and said outer ring member is formed with a groove along the circumferential surface thereof so that said C-shaped contact plate member can be fitted in said groove.

7. The developing device according to claim 6, wherein a conductive grease is filled between said inner and outer ring members for lubricating said ball bearing unit.

8. The developing device according to claim 6, and further comprising means for fixedly coupling said terminal member to said second part of said bearing means.

9. The developing device according to claim 8, said fixedly coupling means comprising a receiving groove provided in an outer peripheral surface of said second part of said bearing means.

10. The developing device according to claim 9, said receiving groove comprising a substantially annular groove.

11. A developing device employed in an electrophotographic imaging device for developing a latent image formed on a charged photoconductive member to a toner image, said developing device comprising:

a chamber for accommodating toner;

a developing roller for charging toner and adhering the charged toner to said latent image formed on the charged photoconductive member;

a terminal member for supplying voltage to said developing roller; and bearing means for rotatably supporting said developing roller, a first part of said bearing means contacting said developing roller while a second part of said bearing means is secured to said imaging device, said first and second parts being electrically connected, wherein said terminal member contacts said second part of said bearing means so that said terminal member is electrically connected to said developing roller, said terminal member being disengagable from said second part of said bearing member independently of said second part of said bearing means, said terminal member comprising a substantially planar member.

12. The developing device according to claim 11, and further comprising means for fixedly coupling said terminal member to said second part of said bearing means.

13. The developing device according to claim 12, said fixedly coupling means comprising a receiving groove provided in an outer peripheral surface of said second part of said bearing means.

14. The developing device according to claim 13, said receiving groove comprising a substantially annular groove.

* * * * *